166-307 3R
6/12/84 XR 4,453,597

United States Patent [19]
Brown et al.
[11] 4,453,597
[45] Jun. 12, 1984

[54] STIMULATION OF HYDROCARBON FLOW FROM A GEOLOGICAL FORMATION

[75] Inventors: Richard A. Brown, Ewing; Frank E. Caropreso, Skillman, both of N.J.; Charles J. Lymburner, Vancouver, Wash.; Robert D. Norris, Cranbury, N.J.

[73] Assignee: FMC Corporation, Philadelphia, Pa.

[21] Appl. No.: 349,331

[22] Filed: Feb. 16, 1982

[51] Int. Cl.[3] ..... E21B 37/00; E21B 43/24; E21B 43/243

[52] U.S. Cl. ..... 166/303; 166/57; 166/260; 166/307; 166/312; 166/306

[58] Field of Search ..... 166/57, 59, 260, 271, 166/300, 302, 303, 307, 308, 311, 312, 306

[56] References Cited

U.S. PATENT DOCUMENTS

| | | | |
|---|---|---|---|
| 2,657,753 | 11/1953 | Carpenter | 166/302 |
| 2,680,486 | 6/1954 | Carpenter | 166/1 |
| 2,680,487 | 6/1954 | Carpenter | 166/1 |
| 3,172,470 | 3/1965 | Huitt et al. | 166/306 X |
| 3,235,006 | 2/1966 | Hujsak | 166/39 |
| 3,250,328 | 5/1966 | Closmana et al. | 166/11 |
| 3,371,713 | 3/1968 | Silverman | 166/38 |
| 3,372,750 | 3/1968 | Satter et al. | 166/11 |
| 3,410,347 | 11/1968 | Triplett et al. | 166/59 |
| 3,459,265 | 8/1969 | Buxton et al. | 166/263 |
| 3,560,407 | 2/1971 | McCormick | 252/462 |
| 3,746,088 | 7/1973 | Haskin et al. | 166/59 |
| 3,768,558 | 10/1973 | Allen et al. | 166/272 |
| 3,774,682 | 11/1973 | Bousaid et al. | 166/302 X |
| 3,777,816 | 12/1973 | Meier | 166/260 |
| 3,817,332 | 6/1974 | Berry et al. | 166/59 X |
| 3,922,173 | 11/1975 | Misak | 106/194 |
| 4,014,721 | 3/1977 | Pusch et al. | 149/108.6 |
| 4,048,078 | 9/1977 | Allen | 252/8.55 |
| 4,053,015 | 10/1977 | Hamrick et al. | 166/302 |
| 4,089,788 | 5/1978 | McCarthy | 252/8.55 |
| 4,116,275 | 9/1978 | Butler et al. | 166/303 |
| 4,217,956 | 8/1980 | Goss et al. | 166/272 |
| 4,265,310 | 5/1981 | Britton et al. | 166/259 |
| 4,271,905 | 6/1981 | Redford et al. | 166/263 |
| 4,282,929 | 8/1981 | Krajicek | 166/302 X |

OTHER PUBLICATIONS

Williams, B., "New Methods Show Promise to Boost Heavy Oil Recovery," *Oil & Gas Journal*, Aug. 31, 1981, pp. 17–21.

Rudnitsky, H. and Gissen, J., "Goo and Residue: Where Tommorow's Profits Are", *Forbes*, Aug. 3, 1981, pp. 36–38.

*Primary Examiner*—George A. Suchfield
*Attorney, Agent, or Firm*—Richard E. Elden; Eugene G. Horsky

[57] ABSTRACT

Means are provided for increasing the productivity of a hydrocarbon formation by modifying the formation in the vicinity of the borehole by a succession of treatments utilizing a first fluid which releases energy within the borehole and a second fluid modifying the fluid within the borehole. The means provides successive treatment of steam, carbon dioxide, oxygen, and inert gases in any order desired.

10 Claims, 3 Drawing Figures

STIMULATION OF HYDROCARBON FLOW FROM A GEOLOGICAL FORMATION

The present invention relates to the stimulation of the flow of hydrocarbons from a formation communicating with a borehole.

A critical factor in the recovery of hydrocarbons is the permeability of the geological formation at the borehole interface. When a well is completed for the primary production phase, packing or well screens are frequently adequate for an unconsolidated formation; fracturing and other physical methods are sufficient for consolidated formations. For the subsequent production phases of a well, the permeability of the formation frequently must be modified to adjust for plugging or to permit the injection of fluids to displace the hydrocarbon to a production well. For example, if water flood techniques are to be instituted it may be necessary to treat the formation to prevent the swelling of clays; or it may be necessary to remove asphaltenes which have deposited in the pores of the formation restricting the flow of the hydrocarbon out of the formation or the flow of the displacement fluid into the formation. Even within a single borehole several producing formations may exist, each of which requires a separate sequence of treatments to optimize the permeability of the formation. In the prior art many methods have been proposed to alleviate the individual problems affecting the permeability of a formation but none of these methods permit the selection of a full range of options for treating an individual formation.

Hujsak, in U.S. Pat. No. 3,235,006, teaches the generation of heat within the borehole by decomposing hydrogen peroxide with a silver or other catalyst. Hujsak also suggests the prior introduction of easily oxidized materials to generate additional heat by their combination with the liberated oxygen when the hydrogen peroxide is decomposed. However, the process provides for no controls other than variation of the quantity and strength of hydrogen peroxide and causes the atmosphere within the borehole to always be an oxidizing atmosphere.

Similarly, McKinnell, in U.S. Pat. No. 3,561,533, teaches the use of hypergolic fuels, such as, hydrogen peroxide plus red-fuming nitric acid or hydrogen peroxide plus hydrazine or unsymmetrical dimethylhydrazine in the form of foams to apply localized heating within a borehole. The teaching of McKinnell is strictly limited to the localized heating within a borehole.

U.S. Pat. No. 3,896,879 by Sareen et al, teaches the stimulation of low permeability deposit by permitting stabilized hydrogen peroxide to diffuse into the minute fractures of a formation. During such diffusion into the fracture, the hydrogen peroxide becomes unstabilized as the stabilizer combines with minerals within the formation; the hydrogen peroxide then decomposes, expands, and increases the permeability of the deposit.

Some methods for secondary recovery of hydrocarbons, of necessity, affect the permeability of the geological formation in the vicinity of a borehole. Such methods include: flame flooding, steam flooding, solvent flooding, carbon dioxide flooding, or inert gas flooding. Any of these methods, if applied for a very short period of time, would affect merely the immediate vicinity of the borehole and essentially be a means of improving the permeability of the formation in that vicinity. However, none of these processes permit sequential and alternate methods to treat the formation. For example, in U.S. Pat. No. 3,896,879, Sareen et al teach a method in the solution mining of metal deposits to increase the permeability of a formation by rapid decomposition of hydrogen peroxide in fissures when the stabilizer has become exhausted by combining with the metal values. The method of Sareen et al not only requires the existence of mineral deposits which can be wetted with an aqueous solution but also lacks the flexibility which is a critical factor of the present invention.

On the other hand, the present invention offers full control over the treatment of the formation in the vicinity of the borehole in a flexible manner to be decided after the equipment is placed within the borehole.

This control is accomplished according to the present invention by introducing into the borehole a first fluid capable of releasing energy in the proximity of the borehole and a second fluid to modify the vapor-liquid composition within the borehole.

The features of the present invention will be best understood with reference to the attached non-limiting drawings.

Figure 3:
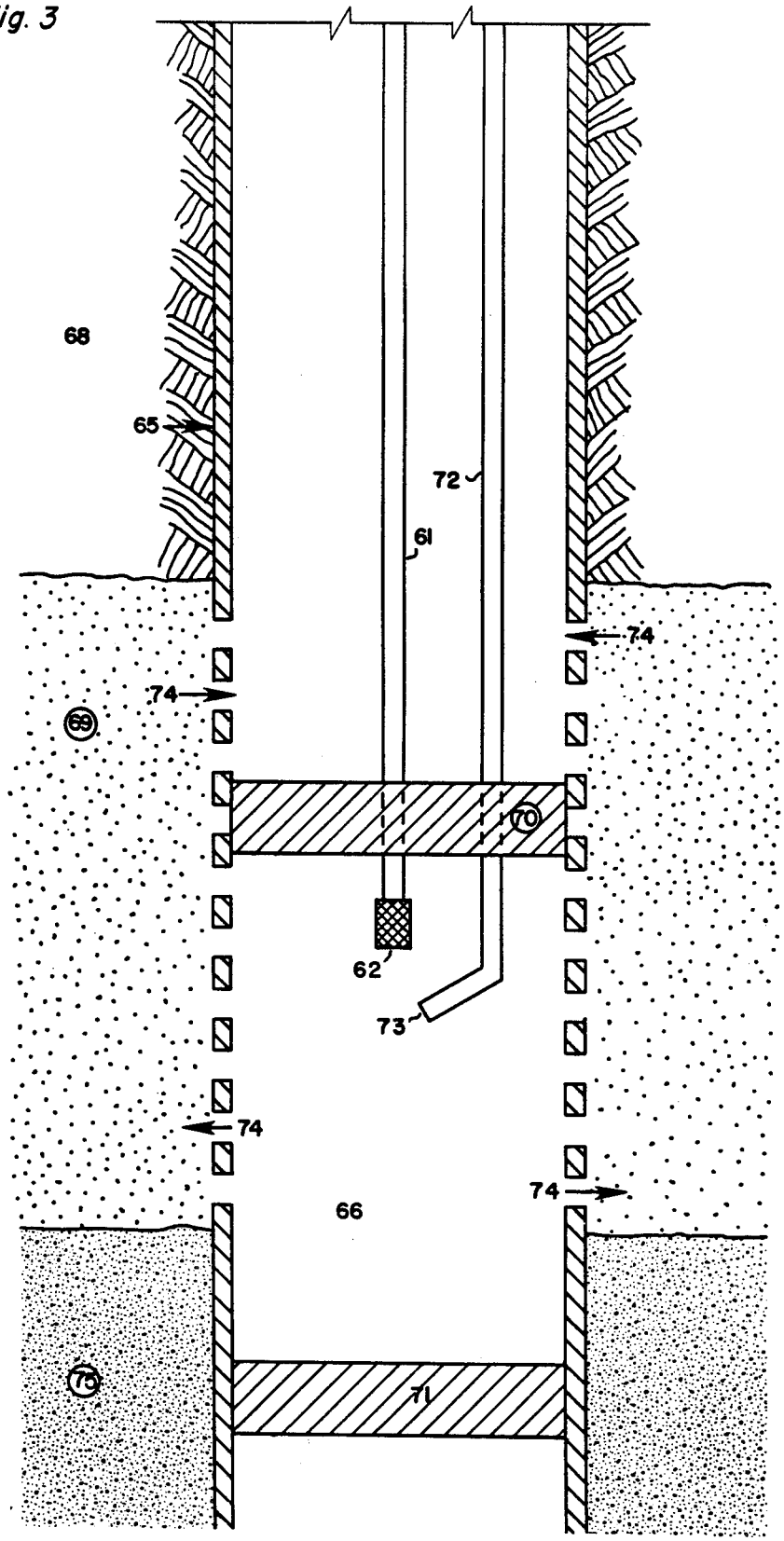

FIG. 3 shows an embodiment mounted in an intermediate position within a geological formation which is sealed off below with a packer to isolate it from any other formations and which permits a dual type treatment of the formation: first, the lower part being exposed to the higher pressure with fluids flowing into the formation; and second, the upper part being open to the top of the borehole being flushed from the inside outward by the fluids and by-products of any reaction.

Figure 1:
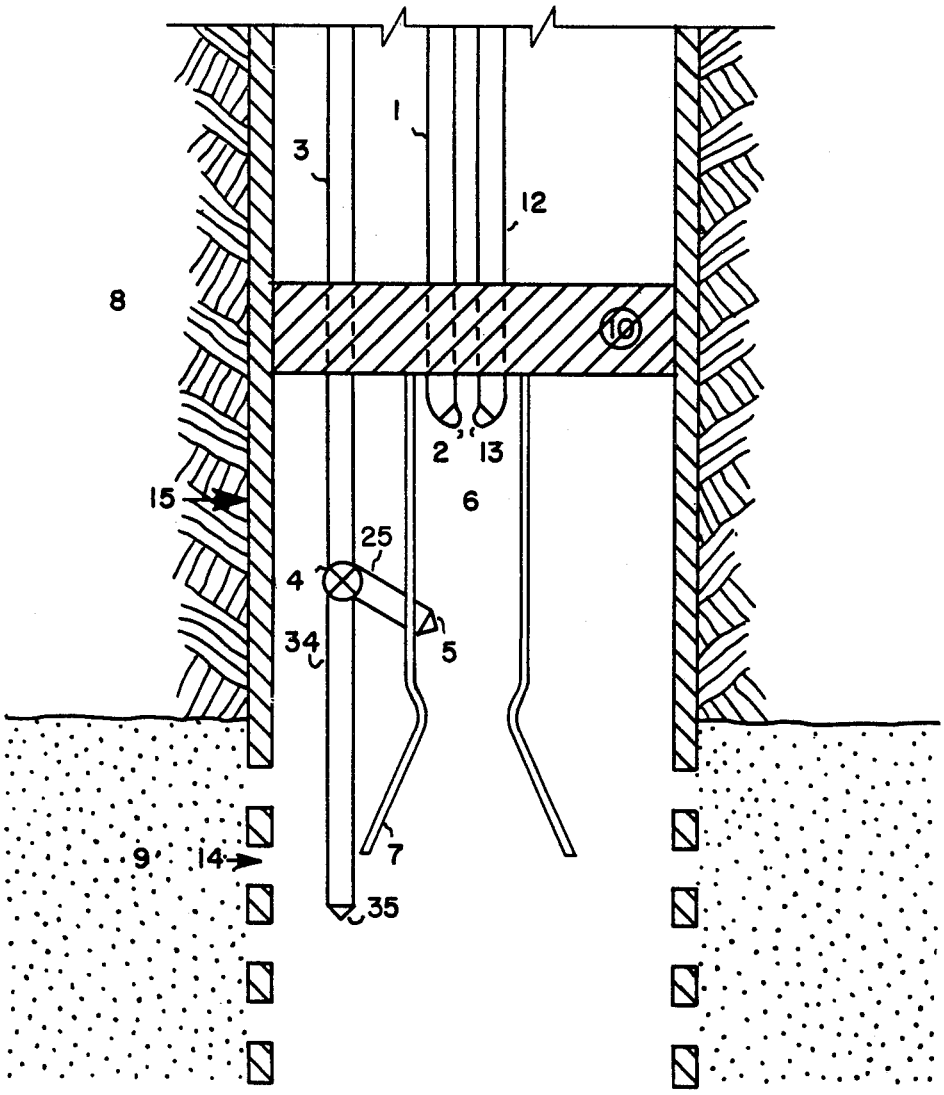
FIG. 1 shows the equipment for an embodiment of the present invention in place in a borehole and is designed to operate using a liquid fuel and a liquid oxidant, such as hydrogen peroxide and hydrazine; or a liquid energy source, such as hydrogen peroxide and a liquid decomposition catalyst.

FIG. 1 shows a cross-sectional view of one presently preferred embodiment of the invention. The Figure shows a cross-section of the borehole with liner (15) penetrating through a formation (8) into hydrocarbon-bearing formation (9). Perforations (14) in liner (15) permit the borehole to communicate with the formation (9). A conventional packer (10) is fixed within the borehole to isolate the hydrocarbon-bearing formation (9) from the surface and from any other hydrocarbon-bearing formation in communication with the borehole. Affixed to the distal side of packer (10) with respect to the surface is a sleeve (7) defining a reaction chamber (6) within the section of the borehole communication with the formation (9). Conduits (1) and (12) extend from the surface through packer (10) into reaction chamber (6). Conduit (1) is terminated within the reaction chamber (6) with the spray head (2) and conduit (12) terminates within the reaction chamber (6) with spray head (13). The said spray heads are so aligned so that fluids introduced through conduits (1) and (12) are thoroughly intermixed within the reaction chamber (6). Conduit (3) also extends from the surface through packer (10) to valve (4) and may from there be directed either into the reaction chamber (6) through conduit (25) and spray head (5) or into the borehole itself through conduit (34) and spray head (35).

In operation, hydrogen peroxide in conduit (1) and a decomposition catalyst solution, such as potassium permanganate, in conduit (12) enter into the reaction chamber (6) where the hydrogen peroxide decomposes in the presence of the catalyst to form steam and oxygen. Water enters through conduit (3) and is mixed with the vapors, either within the reaction chamber (6) through conduit (25) or within the borehole through conduit (34) to form additional steam at a reduced temperature. The water in conduit (3) may, in addition, contain additives, such as surfactants to create a foam; solvents to dissolve hydrocarbons and asphaltenes; or a reducing agent, such as alcohol, which will react with the oxygen, thus releasing energy and forming a reducing atmosphere within the borehole rather than an oxidizing atmosphere. The said reducing agent may also so add to the energy within the system to form superheated steam at a higher temperature than the decomposition of hydrogen peroxide and catalyst alone.

Figure 2:
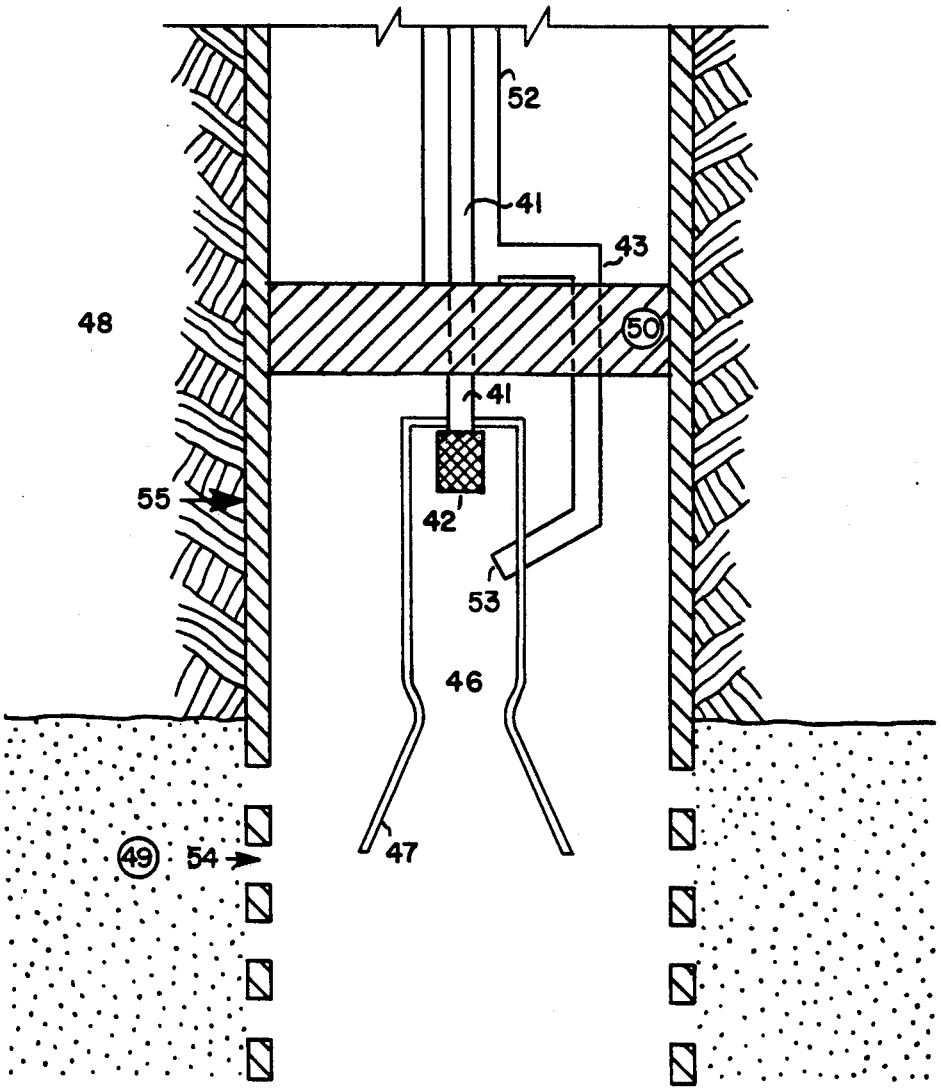
FIG. 2 shows a second embodiment designed to employ liquid hydrogen peroxide decomposed by a solid catalyst bed.

FIG. 2 also illustrates an embodiment of the invention in a borehole penetrating formation (48) into hydrocarbon formation (49). Perforation (54) in liner (55) permits the borehole to communicate with the formation (49). A conventional packer (50) is fixed within the borehole to isolate the hydrocarbon formation (49) from the surface. Conduits (41) and (52) are coaxial and extend from the surface to packer (50). Conduit (41) extends through packer (50) into the inner section of the borehole where it terminates at catalylic bed (42). Affixed to conduit (41) and surrounding the catalytic bed is a tubular section (47) defining a reaction chamber (46). Conduit (43) is extended from the outer coaxial conduit (52) through packer (50) and tubular section (47) terminating with spray head (53).

In operation, a fluid, such as hydrogen peroxide or hydrazine, flows through conduit (41) and decomposes within catalytic bed (42) to form a hot vapor. A fluid flowing through conduit (52) is sprayed through spray head (53) within the reaction chamber (46) to modify the vapors formed from the decomposition of the fluid from conduit (41); and the resulting fluids pass into the borehole and are injected into the hydrocarbon-bearing formation.

FIG. 3 shows yet another preferred embodiment of the invention in which the equipment is installed in a borehole through formation (68) and hydrocarbon formation (69) so that the vapors have a route from the inner section of the borehole into the formation (69) and then out of the formation (69) into the borehole above packer (70) and from there escape to the atmosphere. This flow pattern is accomplished by installing packer (70) in liner (65) such that perforations (74) communicate with the formation (69) on the proximal and distal side of packer (70).

The Figure shows conduits (61) and (72) communicating from the surface through packer (70) into the lower section of the borehole and terminating within the borehole with catalyst bed (62) and spray head (73) respectively. A second packer (71) is shown to isolate the formation (69) from any other formation (75), thus defining the lower section of the borehole as the reaction chamber (66). Hydrogen peroxide or other fluid flowing through conduit (61) is decomposed by catalyst bed (62) and the second fluid flowing through conduit (72) modifies the fluids within the reaction chamber (66). The fluids flow into the formation (69) through perforations (74) below the packer (70) and upwards and out of formation (69) into the section of the borehole on the proximal side of packer (70) with respect to the surface.

Alternatively, the energy of the first fluid may be released by thermal decomposition or by contact with the walls of the reaction chamber or borehole. Further, the energy and the molecular species within the borehole may be further increased by chemical reaction or by activation with thermal means or radiation. The critical feature of this invention is the ability to successively expose the formation in the vicinity of the borehole to steam, oxygen, carbon dioxide, or other fluids in any desired sequence.

Other preferred modes of operating the invention are further described and elaborated in respect with the following specific examples of conditions which may be encountered in a formation.

EXAMPLE 1

A borehole penetrating a consolidated formation of low permeability caused by clay particles is first subjected to a high temperature resulting from the decomposition of 90% hydrogen peroxide in a catalyst bed which results in heating the exit gases to 550° C. These high temperature gases create a thermal shock to the formation causing fractures; and at the same time, the clays, such as kaolinite or montmorillonite are physically and chemically changed. The kaolinite structure is irreversibly altered; the montmorillonite reversibly loses water of crystallization; and further heating to over 600° C. irreversibly transforms it into anhydromontmorillonite. Hydrocarbon materials within the immediate area of the borehole are heated, pyrolyzed, and oxidized by the oxygen from the decomposition of the hydrogen peroxide. After a brief treatment, the temperature of the exit gases is reduced by adding water containing a detergent so that a mixture of steam and condensate is forced into the fractures developed earlier. This cooling creates further thermal shock, further fracturing the material immediately surrounding the borehole—resulting in self-propping fractures, heating, and removing the asphaltenes and paraffins in the formation—thus further improving the permeability of the borehole formation interface.

The temperature and pressure within the borehole is then further reduced by stopping the flow of the fluids from above and venting slowly with pumping, if desired, to flush the fluids from the formation. On further testing, if the permeability is not as desired, treatment may be repeated or an alternate treatment used, such as a high-temperature solvent injection or a carbon dioxide injection at a high temperature and high pressure. All of these alternatives may be selected without changing the apparatus installed in the formation.

EXAMPLE 2

In an alternative example, a decrease in production is observed in a formation, presumably resulting from the migration of high molecular weight, low-viscosity hydrocarbons to the borehole area. After installation of the equipment in the position as shown in FIG. 3, a high temperature flow of steam and condensate is generated to flush the area immediately surrounding the packer. If the pressure and temperature observations at the surface indicate that insufficient clearing has been obtained, a solvent can be injected followed by a high concentration of oxygen; however if these treatments fail, the temperature can be increased until thermal fracturing takes place.

EXAMPLE 3

Alternatively, if the formation is a limestone type susceptible to attack by acid, the preferred treatment is to generate high temperature, super-heated steam within the reaction chamber and inject hydrochloric, hydrofluoric, or other suitable acids or mixtures thereof into the area outside the reaction chamber so that the formation is exposed to hot acid under pressure.

The following more specific examples consider thermal methods alone. For simplicity, consideration is given to the nature of the plugging type material. For example, simple melting is sufficient to restore production of paraffinic type hydrocarbons which can be accomplished by generating a gaseous mixture having a temperature in the range of 150° C. to 260° C. However, if the material has a high proportion of naphthenic materials, more severe temperature conditions are required, such as gas temperatures of 205° C. to 540° C. If extreme cases are encountered, it may be desirable to initiate in situ combustion by generating temperatures in excess of 480° C. to 500° C.

EXAMPLE 4

This example considers the heating of an area surrounding a borehole comprising a cylinder, 6 meters in height and about 0.7 meters in diameter, to a temperature of 150° C. to 260° C. Assuming the formation to have a specific heat capacity of 1,370 gigajoules per kilogram kelvin and an average density of 1,760 kilograms per cubic meter, 2.4 gigajoules are required to increase the temperature from 32° C. to 175° C.; the decomposition of 970 kilograms of 90% hydrogen peroxide in the immediate area of the geological formation will provide the needed energy. Because of heat losses to the formation, somewhat more than this amount of hydrogen peroxide is required for the estimated effect. Preferably, the treatment should be completed in 1 to 12 hours; completion within 2 to 4 hours is more preferable.

EXAMPLE 5

When a higher proportion of naphthenic materials is present a more severe treatment is required—heating to the temperature range of 200° C. to 540° C. The conditions which must be attained are those which cause the plugging materials to be cracked to produce low molecular weight hydrocarbons. Although this cracking can be accomplished alone by thermal effects, it is more effective using oxygen-containing gases at high temperatures. Assuming the same physical conditions as Example 4, a temperature of 480° C. requires 7.6 gigajoules. This energy can be obtained by the decomposition of 970 kilograms of 90% hydrogen peroxide plus the oxidation of 130 kilograms of a suitable fuel, such as kerosene. Alternately, about 3,000 kilograms of hydrogen peroxide can be used. The supplemental use of kerosene is preferred since the cost of operation is less and has the additional advantage of adding carbon dioxide, which further lowers the viscosity of the hydrocarbon material. The operation is completed preferably within 1 to 12 hours, more preferably within 2 to 4 hours.

EXAMPLE 6

In the most severe case in situ combustion is required which can usually be initiated by attaining temperatures in excess of 540° C. in the presence of an oxidizing atmosphere. To treat the same volume as Examples 4 and 5, 9.7 gigajoules have to be supplied to attain these temperatures. However, it is necessary initially to heat only a portion of the volume to this temperature and to provide the rest of the energy by the combustion of the material itself. The key to initiating in situ combustion is a rapid buildup of temperature under oxidizing conditions in a small area. For example, it is necessary to attain the temperature of 540° C. in a zone only about 6 centimeters deep from the wellbore. Consequently, only about 1 gigajoule needs to be provided; this requires decomposition of only 400 to 500 kilograms of 90% hydrogen peroxide. However, the decomposition should take place as rapidly as possible, within 0.025 to 2 hours preferably, or more preferably within less than 0.5 hour. In order to sustain the combustion process, an oxidizing atmosphere must be continuously supplied. The amount of oxygen required for this combustion is determined from the porosity of the formation, the oil saturation of the formation, and the desired rate of flame propagation through the formation. Assuming a porosity of 20% and an oil saturation of 30%, 1,700 cubic meters of oxygen must be supplied to sustain the combustion until the entire area is treated. This oxygen can be supplied by the hydrogen peroxide but preferably by supplying 8,500 cubic meters of air or the 1,700 cubic meters of pure oxygen. The rate of oxidation must be controlled. In this case, given a reasonable rate of flame propagation, the combustion process is to be completed preferably in 12 to 48 hours or more preferably in 8 to 24 hours.

Because of the thermal conductivity of the earth, it is essential that any thermal energy introduced to the system be introduced as close as possible to the formation it is designed to treat. This physical proximity results in an additional advantage for downhole steam generation in that the average temperature of the earth increases with the depth. The average thermal gradient in the earth is 30° C. per kilometer; therefore the average temperature of a borehole at a depth of 600 meters is 30° C. to 35° C. Decomposition of 1,000 kilograms of hydrogen peroxide at the surface of an uninsulated wellbore in a 45 minute period, with 90 pounds of water continuously added, produces an average temperature of steam and oxygen of 400° C. and a pressure of 4.75 megapascals with a total heat imput of 3.8 gigajoules. However, under these conditions there will be no measurable difference observed at the 600 meter depth. The decomposition of hydrogen peroxide must continue for about 4 hours before appreciable steam delivery will begin to be felt at the 600 meter depth and the temperature at this level will soon level off at about 200° C.

We claim:

1. An apparatus for generating fluid compositions within a borehole extending inward from a surface of the earth and for injecting the compositions into a formation communicating with the borehole comprising:

(a) packer means within the borehole separating the borehole into a first section communicating with the surface and a second section communicating with the formation, (b) conduit means for conducting at least two fluids from the surface through the packer means into the second section of the borehole, (c) a heterogeneous decomposition catalyst for liberating energy from a first fluid to provide:

(1) thermal energy, and (2) a vapor composition within the borehole, and (d) means to mix a second fluid with the vapor composition to form a fluid composition for delivery from the borehole into the formation.

2. The apparatus of claim 1 wherein the heterogeneous decomposition catalyst comprises a silver catalyst bed.

3. An apparatus for generating fluid compositions within a borehole extending inward from a surface of the earth and injecting the compositions into a formation communicating with the borehole comprising:

(a) packer means within the borehole separating the borehole into a first section communicating with the surface and a second section communicating with the formation, (b) conduit means for conducting at least two fluids from the surface through the packer means into the second section of the borehole, (c) a third conduit means to inject a fluid decomposition catalyst in the borehole thereby liberating energy from a first fluid to provide:

(1) thermal energy, and (2) a vapor composition within the borehole, and (d) means to mix a second fluid with the vapor composition to form a fluid composition for delivery from the borehole into the formation.

4. The process for stimulating the flow of a hydrocarbon from a formation in communication with a borehole extending inward from a surface of the earth, said borehole containing a packing means to separate the borehole into a first proximal section communicating with the surface, and a second distal section below said packing means communicating with the formation, said borehole being provided with conduit means for conveying fluid from the surface to said second section, said process comprising:

(a) introducing a first fluid capable of releasing energy into the second section of the borehole through the conduit means, (b) causing liberation of energy and vapor from the first fluid into the second section of the borehole, and (c) mixing carbon dioxide into the vapor released in step (b) thus modifying the fluid composition for delivery into the formation.

5. The process of claim 4 wherein the first fluid comprises hydrogen perioxide.

6. The process of claim 5 wherein the hydrogen peroxide contains 10%–35% water.

7. The process for stimulating the flow of a hydrocarbon from a formation in communication with the borehole extending inward from a surface of the earth, said borehole containing a packing means to separate the borehole into a first proximal section communicating with the surface, and a second distal section below said packing means communicating with the formation, said borehole being provided with conduit means for conveying fluid from the surface to said second section, said process comprising:

(a) introducing hydrogen perioxide as a first fluid capable of releasing energy into the second section of the borehole through the conduit means, (b) contacting the first fluid with a decomposition catalyst, causing liberation of energy and vapor from the first fluid into the second section of the borehole, and (c) mixing a second fluid into the vapor released in step (b) thus modifying the fluid composition for delivery into the formation.

8. The process of claim 7 wherein the second fluid in carbon dioxide.

9. The process of claim 7 wherein the hydrogen peroxide contains 10%–35% water.

10. The process for stimulating the flow of a hydrocarbon from a formation in communication with a borehole extending inward from a surface of the earth, said borehole containing a packing means to separate the borehole into a first proximal section communicating with the surface, and a second distal section below said packing means communicating with the formation, said borehole being provided with conduit means for conveying fluid from the surface to said second section, said process comprising:

(a) introducing hydrazine as a first fluid capable of releasing energy into the second section of the borehole through the conduit means, (b) contacting the first fluid with a decomposition catalyst, thereby causing liberation of energy and vapor from the first fluid into the second section of the borehole, and (c) mixing a second fluid into the vapor released in step (b) thus modifying the fluid composition for delivery into the formation.

* * * * *

UNITED STATES PATENT AND TRADEMARK OFFICE

CERTIFICATE OF CORRECTION

PATENT NO. : 4,453,597

DATED : June 12, 1984

INVENTOR(S) : Richard A. Brown et al

It is certified that error appears in the above—identified patent and that said Letters Patent is hereby corrected as shown below:

Column 8, line 13, "perioxide" should read --peroxide--.

Signed and Sealed this

*Twelfth* Day of *March 1985*

[SEAL]

*Attest:*

DONALD J. QUIGG

*Attesting Officer* *Acting Commissioner of Patents and Trademarks*